United States Patent [19]

Dalebout

[11] Patent Number: 4,775,168

[45] Date of Patent: Oct. 4, 1988

[54] SKI POLE

[75] Inventor: Melvin W. Dalebout, Salt Lake City, Utah

[73] Assignee: Daleboot USA, Salt Lake City, Utah

[21] Appl. No.: 931,415

[22] Filed: Nov. 14, 1986

[51] Int. Cl.[4] ..... A63C 11/22; A63C 11/24

[52] U.S. Cl. ..... 280/821; 280/822; 280/824

[58] Field of Search ..... 280/819, 821, 822, 824; 24/197, 590; 135/65

[56] References Cited

U.S. PATENT DOCUMENTS

| | | | |
|---|---|---|---|
| 438,809 | 10/1890 | Harper | 24/590 |
| 4,172,601 | 10/1979 | Hutter | 280/821 |

FOREIGN PATENT DOCUMENTS

| | | | |
|---|---|---|---|
| 2628142 | 5/1977 | Fed. Rep. of Germany | 280/822 |
| 2503571 | 10/1982 | France | 280/821 |
| 687055 | 3/1965 | Italy | 280/821 |
| 562041 | 4/1975 | Switzerland | 280/821 |
| 919589 | 2/1963 | United Kingdom | 280/821 |

*Primary Examiner*—David M. Mitchell
*Assistant Examiner*—Brian L. Johnson
*Attorney, Agent, or Firm*—Trask, Britt & Rossa

[57] ABSTRACT

A ski pole has a handle adapted to urge the shaft forward during a pole plant. The handle has a finger grip attached to the pole and a palm element pivotally connected to the top of the finger element. A spring biases the finger element away from the palm element. The handle may be equipped with a strap that aids in transmission of downward force from a hand to the ski pole. This strap also is adjustable and provides for quick safety release. The ski pole may also be provided with a basket that universally pivots on the bottom of the shaft.

16 Claims, 5 Drawing Sheets

SKI POLE

BACKGROUND OF THE INVENTION

1. Field

This invention relates to ski poles. It is particularly directed to a ski pole with a handle that urges shaft to a forward angle to assist a skier in achieving a forwar reaching pole plant.

2. State of the Art

Standard ski poles typically comprise a roughly cylindrical handle rigidly connected to a straight shaft and a basket rigidly connected to the bottom of the shaft. A common problem with skiers is that they do not plant their ski poles far enough forward. With a straight rigid shaft and handle, it requires a somewhat unnatural or uncomfortable movement of the wrist for the skier to swing the basket far enough forward to achieve a proper pole plant.

There are ski poles that have an offset bend in the shaft near the handle oriented so that the shaft angles forward from the handle. This forward offset causes the basket of the ski pole to be planted farther forward of the skier than is ordinarily the case with poles having a straight shaft. One such pole carries the trademark Kerma, and is manufactured in Sallanche, France under authority of Warrington, Inc., of Lachine, Quebec, Canada.

In other ski poles the shaft is straight, but the handle itself has a broad enough cross section to allow the shaft to be positioned within the handle at a forward angle.

Both of these types of forward-angle poles, however, are rigid. They retain the same shape throughout the entire swing of the pole, thereby presenting a forwardly-angled pole at times when the forward reaching characteristic may be eithr unneeded or awkward.

When a pole is planted the skier's arm transfers considerable force to the ski pole over a very short period of time. To help absorb some of the "shock" of the pole plant there are ski poles that have a spring mounted along the length of the pole so that the handle travels up and down along the length of the pole. One such shock absorber pole is made by Allsop, Inc. of Bellingham, Wash.

The effectiveness of the transfer of downward force from hand or wrist to ski pole depends to some extent on the shape of the handle and the existence and shape of a grip or strap associated with the handle. Many ski poles have leather or other straps that encircle the wrist. These straps may aid in the transfer of downward force; however, they are typically flat belts and may not be comfortable or effective in such transfer of force.

In addition, common plastic baskets have notches or extensions around the outer perimeter of the basket which may catch on trees or twigs. One basket design is one in which the basket is comprised of a circular metal loop with flexible straps connecting the loop to the shaft. These hoop and strap baskets have a smooth outer perimeter, but may have spaces between the straps that may catch on trees or twigs.

Another problem in executing pole plants is that occasionally as a skier attempts a pole plant where the shaft is at an oblique angle to the snow, the basket may keep the tip of the pole from driving into the snow, and the pole plant may be "missed." This problem is particularly evident with common plastic baskets that may become stiff in lower temperatures. Certain ski poles, however, have baskets mounted pivotally to the shaft to permit the basket to pivot universally on the shaft. Hoop and strap baskets also effectively pivot relative the shaft.

SUMMARY OF THE INVENTION

The present invention provides a ski pole with a handle that functions to swing the basket end of the shaft forward, thereby to provide a more forward reaching pole plant. As a skier brings the pole forward, a mechanism within the handle acts to adjust the angle between the skier's wrist and the shaft. The handle thus operates as a "wrist assist." As the wrist is pivoted or cocked to plant the pole, the spring in the handle causes an added cocking or pivoting of the shaft so that the basket swings farther forward, which may eliminate much of the wrist cocking. After the plant, as the skier approaches the pole, his wrist naturally resumes its normal "uncocked" position, and the handle changes configuration to provide a more typical angle between the skier's wrist and the shaft.

An additional advantage of the ski pole handle of this invention is that as the pole is planted, an internal spring in the handle may act to absorb some of the shock of the pole plant. This shock-absorbing feature may be of particular advantage on hard packed snow or ice. The handle of this invention may have more effective shock absorbing characteristics than the poles with a spring mounted along the length of the pole, because the spring of the present invention acts to absorb shock generally in the direction the skier is traveling as the pole is generally upright.

The handle is typically bifurcated at a pivot connection, with one portion connected to the shaft. The handle may thus carry adjustment means enabling the user to adjust the amount of forward cant angle the ski pole achieves in use.

The ski pole handle of this invention may also have a strap which is particularly adapted to transfer downward force from the wrist and hand to the ski pole. This strap may be formed with surfaces which function to bias the hand against the handle and contoured surfaces which receive the lower portion of the hand or the wrist. These surfaces are formed so that as the hand and wrist move downward, force is transferred to the handle through the contact between hand and handle or directly from the hand or wrist to the strap, which then transfers force to the pole. This strap may also be adjustable in length and may provide for a quick release of the strap when significant lateral force is applied to the strap.

In this specification downward force refers to forces along the major axis of the shaft of the ski pole and in the ( direction from the handle toward the basket. This definition contemplates that a skier, for example, when skiing on the side of a hill, may plant a pole and exert "downward force" at a considerable angle from the vertical. Lateral forces refer to forces perpendicular to the major axis of the shaft.

The basket may be pivotally connected to the bottom of the shaft. This pivotally mounted basket may work in conjunction with the pivoting action of the handle to maintain the handle and basket in roughly stationary rotational orientations, while, in effect, the pole rotates between them. This configuration may provide a more smooth and flowing pole swing. A swivel connection may be fashioned as a ball and socket arrangement.

In a typical ski pole of this invention, a handle includes a finger grip fashioned with a cylindrical bore adapted to receive a ski pole shaft. The finger grip may have smooth rounded detents on the front face adapted to register with fingers. A palm grip is pivotally connected to the top of the finger grip to extend down from the pivot point opposite the front face of the finger grip. A spring may be positioned between the finger and palm grips to bias the finger grip away from the palm grip. A ski pole shaft is positioned within the cylindrical bore of the finger grip and firmly connected thereto. A snow basket is attached to the bottom of the shaft, preferably ball and socket joint.

As a skier grasps the handle, the fingers wrap around the finger grip; the palm grip is positioned in the palm area of the hand. As the palm and fingers are closed together, the finger and palm grips are brought together until the palm grip contacts the finger grip. At this point, the handle resembles a typical roughly cylindrical ski pole handle. As the handle rests in the hand and the fingers are relaxed, the spring acts to push the finger grip, which contains the shaft, away from the palm grip. Thus, as the skier pivots or cocks his wrist forward and relaxes his fingers, the spring pushes the shaft to its forwardly canted position in preparation for the pole plant, thus limiting the required amount of wrist cocking.

The palm grip has a lower flared section which offers resistance against the hand as it moves downward on the handle. This lower flared section aids in the transfer of downward force from the hand to the ski pole.

The palm grip also has an upper flared section which tends to restrain the hand from sliding up and off the handle. This upper flared section also interferes with an upper portion of the finger grip when the handle is in the open position. This interference establishes the maximum distance the palm and finger grip may be biased away from each other. Alternatively, the handle may be provided with an adjustment means so that the maximum achievable cant angle may be adjusted. This adjustment means may be comprised, for example, a turn screw arrangement.

A strap is connected near the pivoting axis of the palm and finger grips. A portion of the strap which is positioned to register with the lower portion of the hand is flattened and contoured, so that the hand may effectively transfer downward force to this contoured portion of the strap. The strap is also sized so that the back portion of the strap registers with the back of a hand, thereby biasing the palm area of the hand against the palm grip of the handle.

DETAILED DESCRIPTION OF THE DRAWINGS

Figure 1:
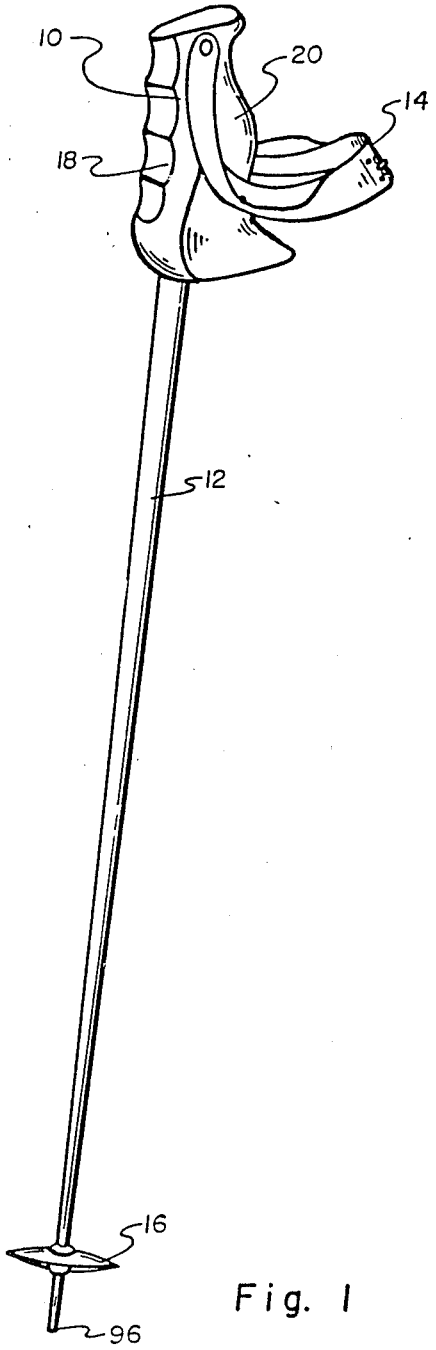
FIG. 1 is a side view of a ski pole of the invention.
Figure 2:
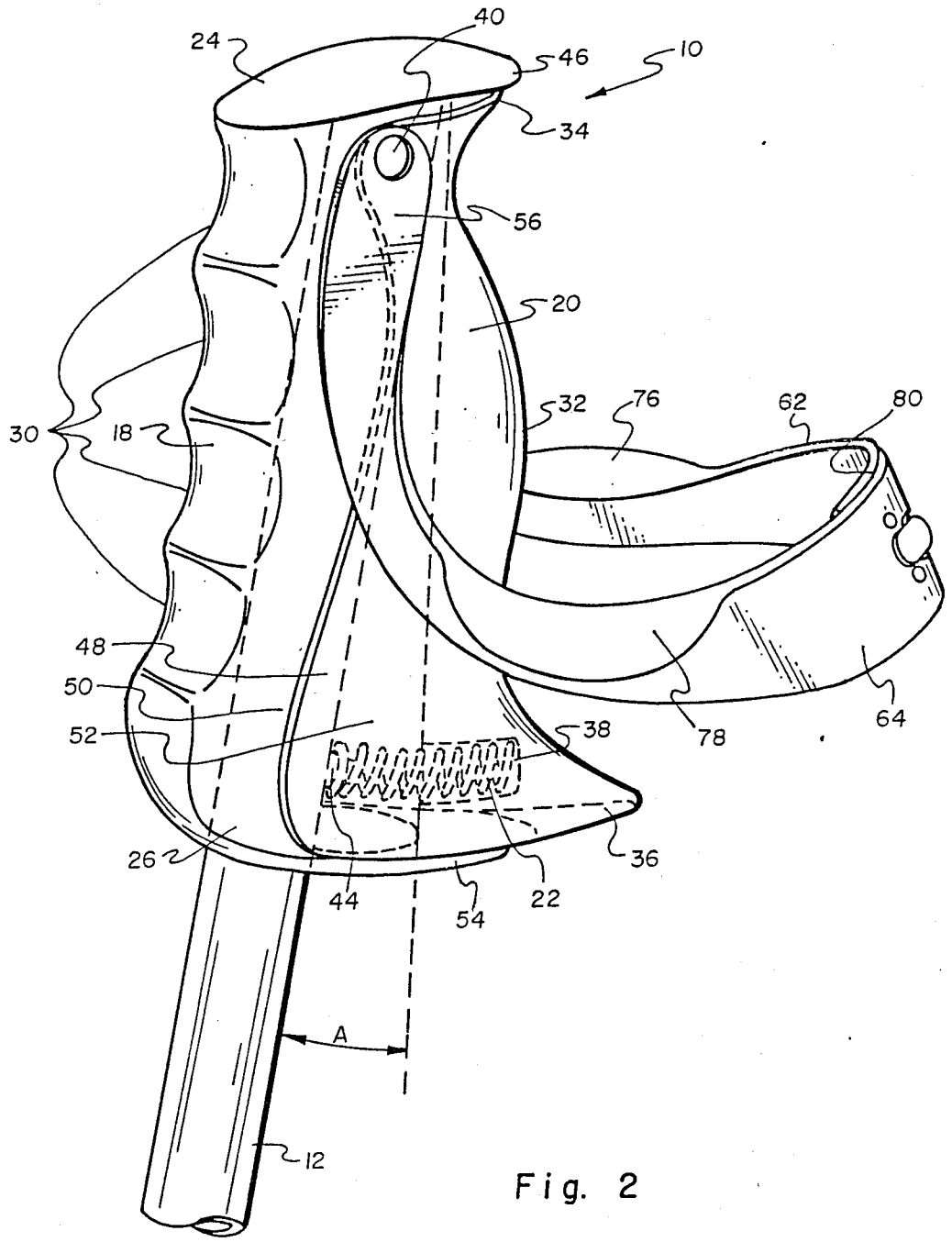
FIG. 2 is a side view of a handle of the invention in an open position.

Referring to FIG. 1, a ski pole of the invention comprises a handle 10, a shaft 12, a strap 14, and a pivoting basket 16. Referring to FIG. 2, the handle 10 is comprised of a finger grip 18, a palm grip 20, and a spring 22. The finger grip 18 is an elongated body composed of durable rubber or plastic. It has a top 24 and a cylindrical bore 26 which is adapted to snugly and securely receive the ski pole shaft 12. The finger grip 18 has four rounded detents 30 which are adapted to receive the fingers of a hand.

The palm grip 20 is composed of a rigid material such as hard plastic. It has a bulged section 32, an upper flared section 34, a lower flared section 36, and a cylindrical bore 38. The palm grip 20 and finger grip 18 are pivotally connected by means of two self tapping screws 40, as shown. As shown, the palm grip 20 and finger grip 18 are of approximately the same length.

The bulged section 32 is sized and positioned to be placed within the palm of a hand when the handle is in use. The upper flared section 34 is adapted to preclude a hand from slipping upward and off the handle 10 when it is in use. The lower flared section 36 is adapted to preclude a hand from slipping downward and off the handle 10 when the handle is in use.

Figure 3:
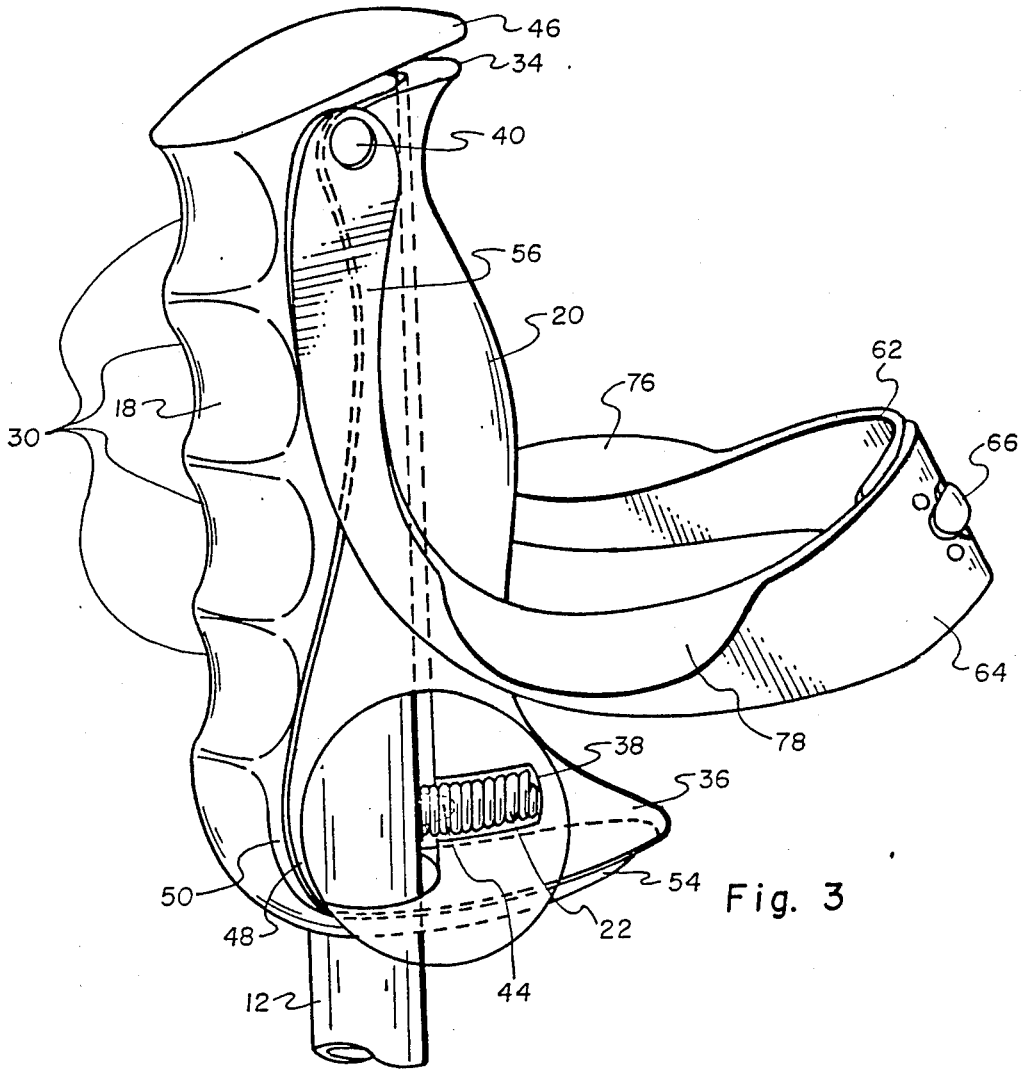
FIG. 3 is a side view of a handle of the invention in a closed position.

The spring 22 is placed in the bore 38. The spring 22 connects with the knob 44 of the finger grip 18 as shown and biases the finger grip 18 away from the palm grip 20. As the finger grip 18 reaches its maximum distance from the palm grip 20, the upper flare section 34 of the palm grip 20 interferes with the ridge 46 of the finger element 18. This interference stops further pivoting of the finger grip 18 with respect to the palm grips. The maximum forward cant angle A of the pole is thus preselected. The finger grip 18 may also be biased toward the palm grip 20, compressing the spring 22, in which event the handle assumes a more nearly cylindrical shape as depicted in FIG. 3.

The sides 48 of the palm grip 20 and the sides 50 of the finger grip 18 associate in a close fit relationship. As shown in FIG. 3, the sides 48 of the palm grip are sized so that when the handle 10 is in its closed position, the sides 48 do not interfere with the detents 30 (FIG. 3), yet are large enough to remain in registration with sides 50 when the handle 10 is in its open position (FIG. 2).

An elongated tongue 54 projects from the bottom of the finger grip 18 toward the flared section 36 as shown. The tongue 54 covers the bottom of the interior chamber 52 as the handle 10 moves between its open and closed positions. The combination of the sides 48 and 50 and the tongue 54 effectively seal the interior chamber 52 from exposure to snow or other unwanted debris and also prevents a skier's hand or glove from being caught or pinched as the elements of the handle 10 pivot.

Figure 4:
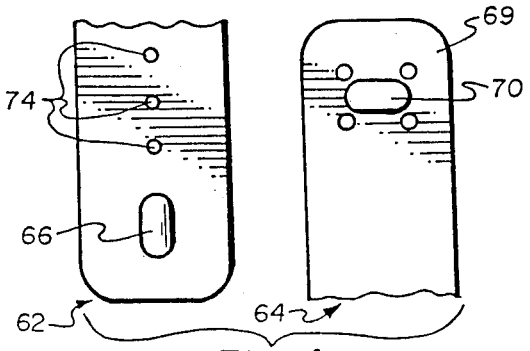
FIG. 4 is a front view of a strap fastener of the invention.
Figure 5:
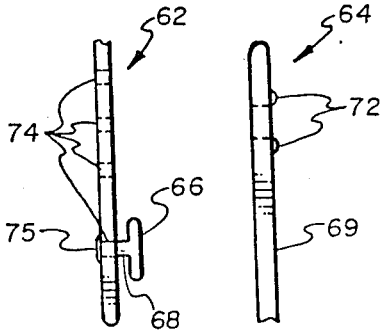
FIG. 5 is a side view of a strap fastener of the invention.

FIG. 2 illustrates a strap 56 connected to the handle 10 by means of two self tapping screws 40. The strap 56 includes a male belt portion 62 and a female belt portion 64. As best shown by FIGS. 4 and 5, the male belt portion 62 includes an oval appendage 66 which is firmly attached to the male belt portion 62 by means of a neck 68. The female belt portion 64 has a bottom piece 69 with an oval slot 70 and four knobs 72.

Figure 8:
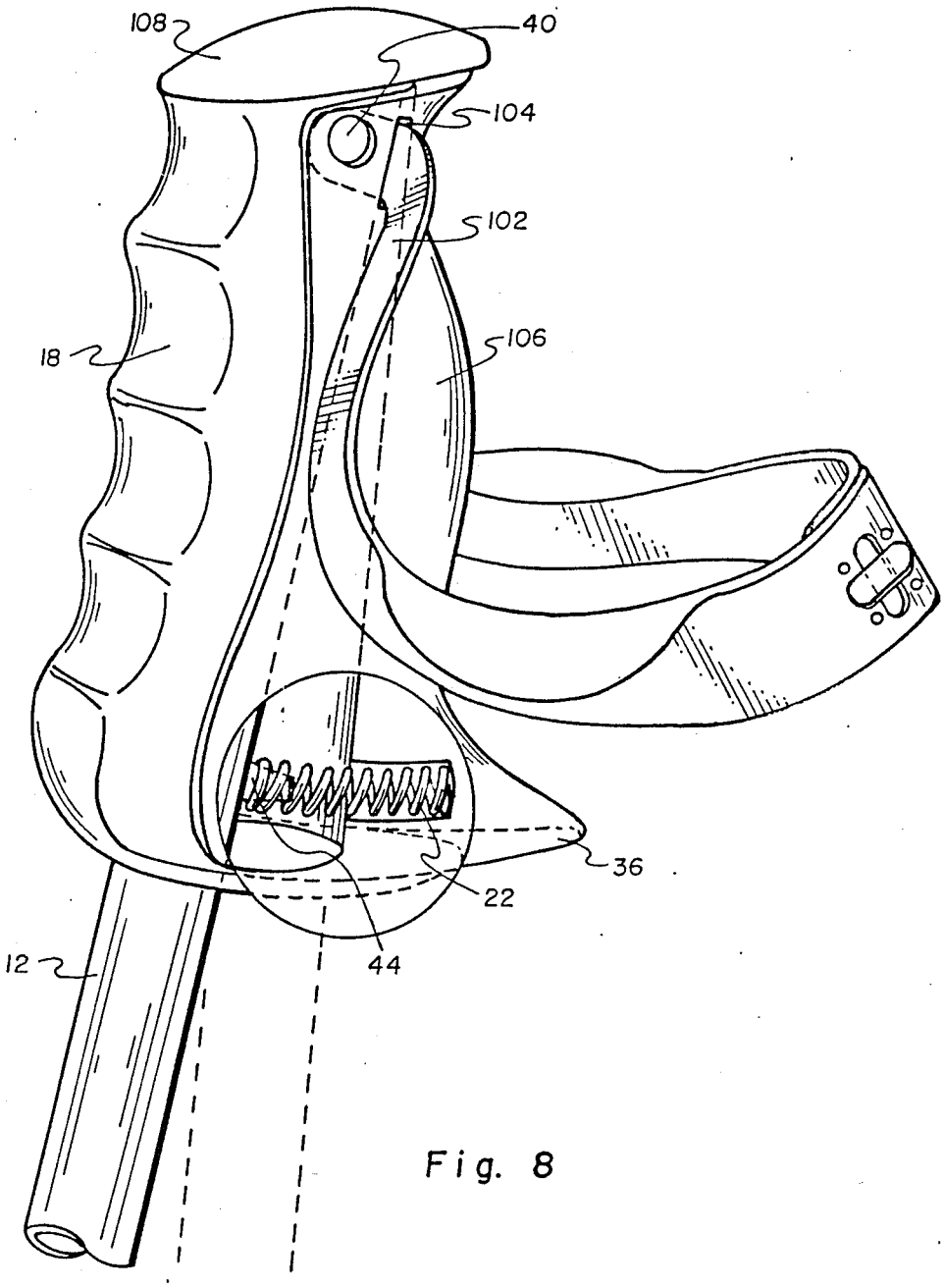
FIG. 8 is a side view of an alternative embodiment of the handle and strap of the invention.

The strap 56 is fastened by rotating the male belt portion 62 approximately 90° from the orientation shown in FIG. 4. The oval appendage 66 is then placed within the oval slot 70. The male portion 62 is then rotated back to its original orientation and the oval appendage rests a top the bottom piece 69 and between the knobs 72. This fastened orientation is illustrated in FIGS. 2, 3, and 8.

The male belt portion has a plurality of cylindrical holes 74 which are adapted to receive the appendage 66. The length of the strap 56 when fastened may thus be adjusted by selecting the appropriate hole 74 to which to attach the appendage 66. The appendage is firmly fixed to the male belt portion 62 by a self tapping screw 75. Alternatively, the female belt portion may have a plurality of slots 70 so that a skier can adjust the length of the strap 56 by simply selecting the appropriate slot 66 in which to place the appendage 66.

Both belt portions (62 and 64) have contoured portions 76 and 78, which are formed and adapted to receive a lower hand area and/or wrist as the pole is in use. The strap 56 is of such a length that the back 80 of the strap 56 will offer resistance against the back of a hand and/or wrist to bias a palm area of a hand against the palm grip 20. The sizing of the strap takes into account typical gloves or mittens which may be worn by a skier. The appendage 66 is preferably made of hard plastic. Other portions of the strap 56 are preferably made of a flexible but moldable material such as soft polyurethane.

Figure 6:
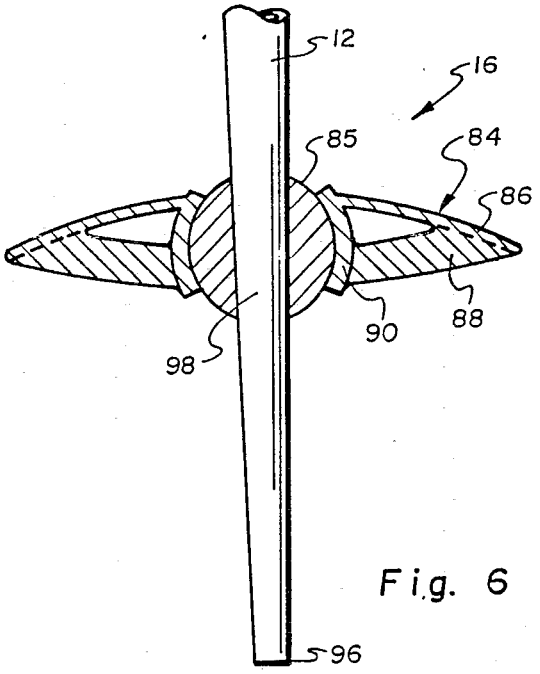
FIG. 6 is a cross-sectional view of the basket 16 of FIG. 1.
Figure 7:
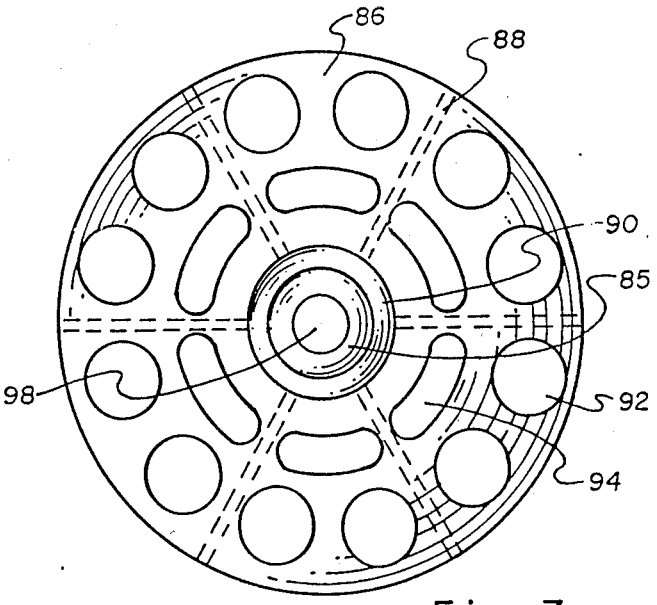
FIG. 7 is a top view of the basket 16 of FIG. 6.

FIG. 6 is a cross-sectional view of the basket 16. It is comprised of a cup 84 and a ball 85. The cup is comprised of a domed section 86, a plurality of ribs 88, and a socket 90. The domed section 86 forms an inverted bowl, as shown, for providing resistance against snow. As shown in FIG. 7, section 86 has a circular outer perimeter. Domed section 86 also has a plurality of circular holes 92 and elongate holes 94 which make the domed section 86 lighter in weight. Enough surface area is left in the domed section 86 so that the cup 84 will offer effective resistance against a snow surface.

The ribs 88 connect between the socket 90 and the domed section 86 and give strength to the domed section 86. The socket 90 universally pivots on the ball 85. The ball 85 connects with the shaft 12 near tip 96 at the truncated conical hole 98 in the ball 85 as shown. The cup 84 is formed of a light rigid material, preferably urethane. The ball 85 is formed of a smooth hard substance, preferably nylon. The ball 85 is press fit in place on the shaft 12.

FIG. 8 illustrates an alternative embodiment of the handle and strap of the invention. Rather than connect on the outside of the palm grip as depicted in FIGS. 1–3, the strap 102 extends through slots 104 in the palm grip 106 and connects to the handle 108 by the self tapping screws 40 as shown. The palm grip 106 thus adds strength to the connection between the strap 102 and the handle 108.

The ski pole of this invention functions as follows: As a skier swings the pole forward and cocks his wrist to execute a pole plant, he naturally releases tension on the finger grip 18 with his fingers. The spring 22 then pushes the finger grip 18 away from the palm grip 20. The back 62 of the strap biases the skier's hand against the palm grip 20. The skier's palm offers resistance against the palm grip 20 and the shaft 12 is thrust forward at a forward angle relative the palm grip 20. This forward angle assists the skier in achieving a more forward pole plant.

As the pole is planted the finger grip 18 and the palm grip 20 begin to collapse toward each other. The spring 62 thus helps absorb the shock of the pole plant.

As stated, the back 62, of the strap biases the skier's hand against the palm grip 20, thus causing more friction resistance between the hand and the handle 10 as the skier's hand is thrust downward. In addition, the lower portion of the hand registers with both the lower flared section 36 of the palm grip 20 and the contoured portions 76 and 78 of the strap 56. These registrations also provide effective means for transfer of downward force from hand to ski pole.

After the pole is planted in the snow, the skier approaches the position where the pole is planted. The skier's palm will continue to offer resistance against the palm grip 20. The palm grip 20 and the finger element 18 will then collapse back to the closed position, as illustrated in FIG. 3. The skier has control over the rate at which the finger grip 18 and palm grip 20 collapse on each other by the inward force he exerts with his fingers against the finger grip 18 and by the orientation of his wrist. Once the skier travels past the position where the basket 16 has been planted, the skier may pull the basket up out of the snow and the pole is ready for the next pole plant.

The pivoting basket 16 works in conjunction with the handle 10. As the pole is planted, the basket 16 pivots to match the snow contour. As the skier moves forward, the shaft 12 pivots on the basket 16 and the shaft 12 also pivots with respect to the palm grip 20. The wrist is allowed to be more rotationally stationary, and the pole effectively pivots between the basket 16 and the wrist.

The pivoting basket 16 also helps preclude the skier from "missing" a pole plant. If a skier attempts a pole plant with the shaft at an oblique angle to the snow, such as planting down hill on a steep slope, the basket will pivot sufficiently to allow the tip 96 of the pole to penetrate the snow. After the tip penetrates the snow, the basket will register with the snow and the pole plant may be executed.

Another advantage of the basket 16 is that it is adapted to avoid catching on trees or bushes. The smooth outer perimeter of the domed section 86 and the relatively small size of the plurality of holes 92 and 94 help preclude the basket 16 from becoming entangled in trees or bushes. Yet the basket 16 retains the advantages of lightness and durability. Many skiers may also find baskets within the contemplation of the embodiment of FIGS. 6 and 7 more aesthetically pleasing than commonly encountered baskets.

The strap 56 has a quick release characteristic. If the strap undergoes significant lateral force, such as during a hard fall, or catching on trees or twigs, the appendage 66 breaks free of the selected slot 70 and the ski pole is then disconnected from the skier's wrist. Movement of the wrist under many such circumstances naturally tends to rotate the belt portions 62, 64 with respect to each other, bringing the oval appendage 66 into registration with the oval slot 70, thereby facilitating their disconnection. Alternatively, the user can intentionally quick release the strap by wrenching or twisting the strap vigorously. Such a quick release might be necessary, for example, at the top of a ski lift or after a fall in deep snow.

Another advantage of the handle 10, strap 14, and basket 16 is that they can be economically attached to existing shafts. A pair of handles 10, straps 14, and baskets 16 could be sold as a kit. A skier could purchase the kit, remove the handles and baskets from poles he already owns, and attach the handles to his old shafts at the cylindrical bore 26 of the handle and at the truncated conical hole 98 in the ball 85. Suitable cement or glue may be used to hold the pieces together.

Reference herein to details of the illustrated embodiment is not intended to restrict the scope of the appended claims, which themselves recite those features regarded as essential to the invention.

I claim:

1. A ski pole comprising:

a handle with a top end and a shaft-receiving bottom end, said handle including:

first and second elements pivotally connected to each other about a transverse axis near said top end, the first of said elements including said bottom end of said handle, and biasing means for urging the second of said elements away from said bottom end; said second element having a bulged section sized and positioned to receive the palm of a user's hand and a shaft with first and second ends, with said first end placed within and firmly connected to said bottom end of said handle.

2. A ski pole according to claim 1, wherein said first element has a plurality of detents adapted to receive the fingers of a hand.

3. A ski pole according to claim 1, wherein said handle further comprises a lower flared section formed on said first section near said bottom end, which is adapted to aid in the transfer of downward force from a hand to said handle.

4. A ski pole according to claim 1, further comprising a strap for connection of said handle to a wrist, said strap having a back portion for biasing a palm against said handle and contoured portions formed and adapted on said strap to receive the lower portion of a user's hand as said pole is in use and for transmitting downward force from said hand to said handle.

5. A ski pole according to claim 4, wherein said strap has fastening means for fastening said strap and for releasing when a preselected amount of lateral force is exerted on said strap.

6. A ski pole according to claim 5, wherein said fastening means comprises:

a first belt portion having a first longitudinal axis and a raised appendage having a longer axis parallel said first longitudinal axis; and a second belt portion having a second longitudinal axis with a slot with a longer axis transverse said second longitudinal axis.

7. A ski pole according to claim 6, wherein said second belt portion has a plurality of said slots for adjusting the length of said strap.

8. A ski pole according to claim 6, wherein said appendage has a plurality of selectable positions upon said first belt portion for adjusting the length of said strap.

9. A ski pole according to claim 1, wherein said handle has adjustment means for adjusting the distance that said second element may be biased away from said first element.

10. A ski pole according to claim 1, further comprising a basket pivotally connected to said second end of said shaft.

11. A ski pole according to claim 10, wherein said pivotal connection is a ball and socket arrangement.

12. A ski pole according to claim 10, wherein said basket further comprises a rigid dome having a generally smooth outer perimeter.

13. A ski pole according to claim 12, wherein said dome has a plurality of holes which are small relative to the size of said dome.

14. A ski pole according to claim 10, including a basket connected to said second end of said shaft, said basket comprising:

a rigid dome having a smooth outer parimeter and a plurality of holes which are small relative to the size of said dome; and a ball and socket connection between said basket and said ski pole.

15. A ski pole according to claim 14, further comprising a plurality of ribs connected to said dome to add strength thereto.

16. A ski pole according to claim 14, wherein said basket has a circular outer perimeter.

* * * * *